United States Patent [19]

Arguello et al.

[11] 4,275,701

[45] Jun. 30, 1981

[54] IGNITION CONTROL SYSTEM

[75] Inventors: Leonard E. Arguello, San Jose; Lawrence M. Blaser, Mountain View, both of Calif.

[73] Assignee: Fairchild Camera & Instrument Corp., Mountain View, Calif.

[21] Appl. No.: 33,667

[22] Filed: Apr. 26, 1979

[51] Int. Cl.[3] ..... F02P 9/00

[52] U.S. Cl. ..... 123/609; 123/146.5 A

[58] Field of Search ..... 123/148 E, 117 R, 146 JA

[56] References Cited

U.S. PATENT DOCUMENTS

| | | | |
|---|---|---|---|
| 3,881,458 | 5/1975 | Roozenbeek et al. | 123/148 E |
| 3,882,840 | 5/1975 | Adamian et al. | 123/148 E |
| 3,938,490 | 2/1976 | Snyder et al. | 123/148 E |
| 4,052,967 | 10/1977 | Colling et al. | 123/148 E |
| 4,057,740 | 11/1977 | Arguello | 123/148 E |
| 4,095,576 | 6/1978 | Hattori et al. | 123/117 R |
| 4,100,895 | 7/1978 | Hattori et al. | 123/117 R |
| 4,155,340 | 5/1979 | Fernquist et al. | 123/148 E |
| 4,170,209 | 10/1979 | Petrie et al. | 123/148 E |

*Primary Examiner*—Charles J. Myhre
*Assistant Examiner*—R. A. Nelli
*Attorney, Agent, or Firm*—Paul J. Winters; Ronald J. Meetin; Michael J. Pollock

[57] ABSTRACT

An ignition control system typically used with an automobile engine provides tight feedback control on engine timing. An integrator produces a waveform which is typically dual-slope in response to a timing signal supplied by a sensor responsive to rotation of a distributor. A dwell-control circuit produces a dwell-control reference signal which varies with the integrator waveform voltage at low engine speed. A comparator generates an output drive-control signal when the integrator waveform voltage equals or is less than the dwell-control reference voltage. An output drive circuit produces an activation signal in response to the drive-control signal to activate an output drive circuit which then supplies an ignition signal to an ignition coil. A feedback loop between the output drive circuit and the output drive-control circuit causes the output drive circuit to stabilize at a selected state such as a specified output current level. A feedback loop between the output drive circuit and the dwell-control circuit controls the level of the dwell-control reference voltage and thereby controls the dwell period.

12 Claims, 8 Drawing Figures

| FIG.3A | FIG.3B |
|---|---|

IGNITION CONTROL SYSTEM

BACKGROUND OF THE INVENTION

1. Field of the Invention

This invention relates to an electronic ignition control system for use in internal combustion engine applications. More particularly, it relates to such an ignition control system having an improved feedback loop for dwell control.

2. Description of the Prior Art

Conventional or Kettering automobile ignition systems make use of mechanical breaker points which are periodically opened by cams to interrupt the passage of electrical current through the ignition coil, thus inducing high voltage signals in the secondary winding of the coil, which provide the spark at the plugs for ignition. A primary problem with such an electro-mechanical system is that the breaker points have a limited life expectancy; consequently, there is a need for periodic tune-ups to keep the engine running smoothly.

As semiconductor device and integrated circuit technology has developed, it was soon perceived that integrated circuits could be used as electronic substitutes for the cam operated breaker points and their associated condenser. The initial thrust of electronic ignition control systems has been to simply duplicate the performance characteristics of the conventional system. An example of such an electronic ignition system is disclosed in Arguello, U.S. Pat. No. 4,057,740. In that system, a comparator circuit compares an input signal from a sensing means in a distributor against a constant reference voltage and produces output signals when the input signal exceeds the constant reference voltage.

It is further recognized in the electronic ignition control system art that electronic ignition systems need not be limited by certain design compromises in the signals produced using mechanical breaker points because mechanical wear is not a problem in an electronic system. For example, Adamian et al. in U.S. Pat. No. 3,882,840 disclose an electronic ignition system in which a higher primary energy may be employed with the ignition coil then has been found practical with mechanical breaker points. This consideration in particular is of great significance for present day automobile engines, which operate with leaner combustion mixtures than previously employed, both for fuel economy and anti-pollution reasons.

One aspect of the system of Adamian et al. is a feedback loop from the output of the system there disclosed to a dwell control circuit. This feedback loop allows variation in dwell angle or dwell time for different engine operating conditions. However, such a long feedback loop makes it difficult to achieve tight control over dwell, particularly as the control requirements become more stringent with further demands for increased fuel economy and pollution control in internal combustion engines.

SUMMARY OF THE INVENTION

Accordingly, it is an object of this invention to provide an ignition control system in which current supplied to the ignition coil of an internal combustion engine may be provided at an optimum level for engine performance without adversely affecting life expectancy of the ignition control system.

It is another object of the invention to provide an ignition control system with a tighter control loop for dwell time which is more responsive to changes in engine operating conditions than previous dwell time control loops.

It is a further object of the invention to provide an ignition control system in which dwell time is controlled at all engine speeds and accelerations to achieve optimum system efficiency.

These and related objects may be achieved through use of the novel electronic control system herein disclosed. This ignition control system is designed to be connected between a sensing means responsive to rotation of a distributor to produce a timing signal and an output drive circuit connected to the primary winding of an ignition coil. The system includes an integrating circuit connected to receive the timing signal from the sensing means. The integrating circuit produces a dual-slope waveform in response to the timing signal. A dwell-control circuit is connected to receive the dual-slope waveform from the integrating circuit and produce a dwell-control reference voltage. At low engine speed, the dwell-control reference voltage varies in response to variation in the dual-slope waveform. A comparator circuit is connected to the dwell-control circuit to receive the dwell-control reference voltage and to the integrating circuit to receive the dual-slope waveform. The comparator produces an output drive-control signal when the voltage of the dual-slope waveform equals or is less than the voltage of the dwell-control reference signal. An output drive-control circuit is connected to the comparator circuit to receive the output drive-control signal from the comparator. The output drive-control circuit is also connected to the output drive circuit to supply an activation signal to the output drive circuit in response to the output drive-control signal.

While this system may be employed with any sensing means which will produce a rectangular timing signal in response to rotation of the distributor, it is preferred to employ the system with a Hall-effect sensing device. A commercially available example of such a sensing device is Honeywell Micro-Switch product 1AV2A, obtainable from Minneapolis Honeywell, Inc., Minneapolis, Minn. While this control system is further usable to control a wide variety of output drive circuits, it is preferably employed with a Darlington transistor pair as the output drive circuit.

A pair of feedback loops from the output drive circuit to the output drive-control circuit and to the dwell-control circuit in the ignition control system of this invention provide much tighter control over dwell time or dwell angle under widely varying engine operating conditions than may be obtained with prior art ignition control systems. On this basis, the system should be of significant advantage for increasing fuel economy and decreasing exhaust emissions.

The attainment of the foregoing and related objects, advantages and features of the invention should be more readily apparent after review of the following more detailed description of the invention, taken together with the drawings, in which:

DESCRIPTION OF THE PREFERRED EMBODIMENT

In the following description, C, D, Q or R as the first letter of a reference symbol indicates that the referenced item is a capacitor (including a transistor connected as a capacitor), a diode (including a transistor connected as a diode), a transistor, or a resistor, respectively. Z as the first letter similarly indicates a Zener diode (including a transistor connected as a Zener diode). Likewise, CR as the first letters indicate a diode.

Figure 1:
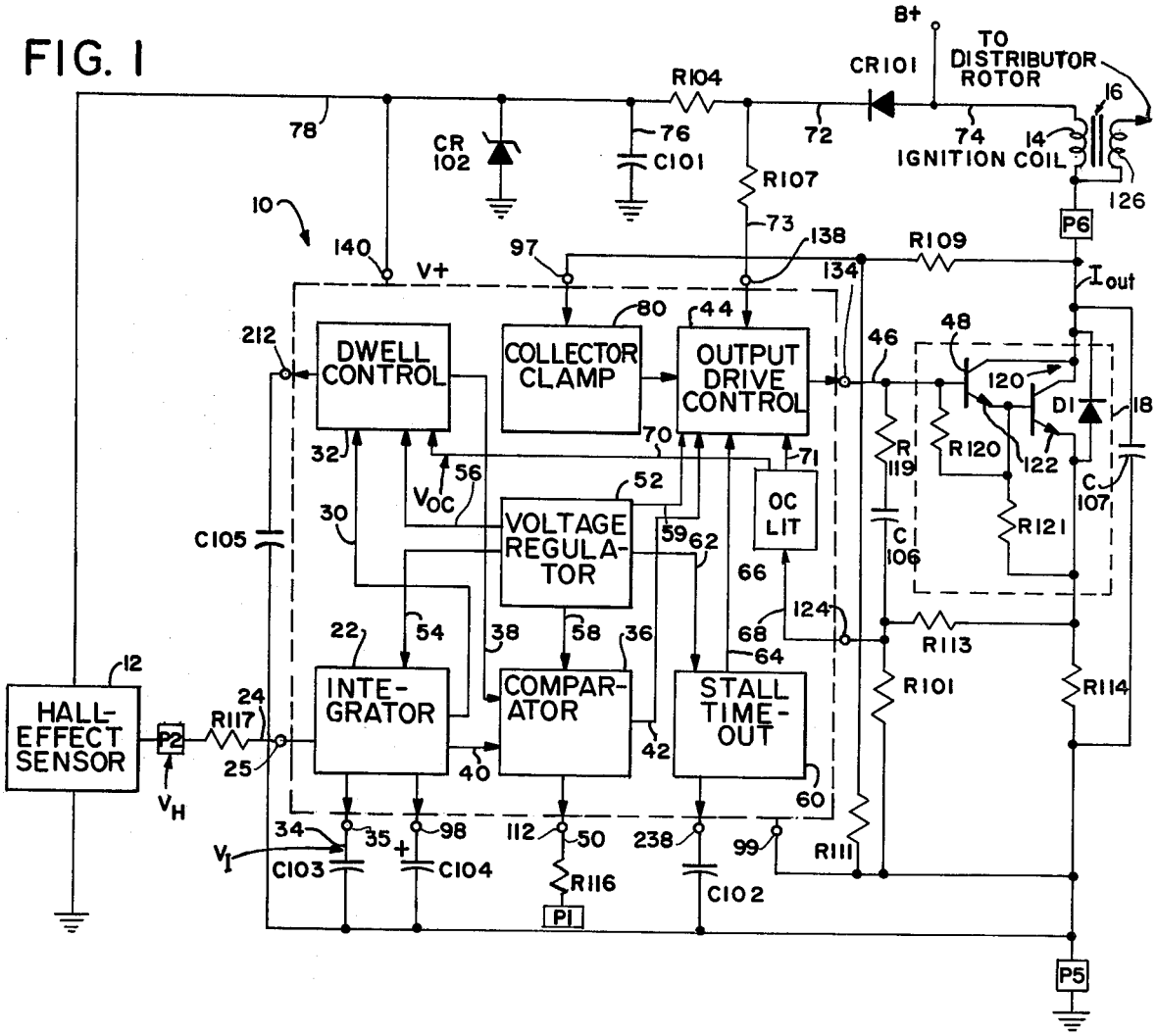
FIG. 1 is a block diagram of an ignition control system in accordance with the invention.

Turning now to the drawings, more particularly to FIG. 1, there is shown a block diagram of an electronic ignition control system 10 in accordance with the invention. The block diagram of FIG. 1 will be considered in conjunction with the representative waveforms of FIG. 2. The ignition control system 10 is connected between Hall-effect sensing device 12 and primary winding 14 of ignition coil 16. Physically, the elements of the ignition control system 10 shown as functional blocks are preferably implemented together in a single bipolar linear integrated circuit chip. That integrated circuit chip is packaged in a module containing a Darlington pair output drive circuit 18 made by Fairchild Camera and Instrument Corporation, Mountain View, CA, under the product designation 0361. The module also includes various discrete resistors, capacitors and diodes, the functions of which will be explained below.

An input signal 20 for the ignition control system 10 is supplied to an integrator circuit 22 through module terminal P2 and resistor R117 via line 24. The Hall-effect sensing device 12 is mounted inside the distributor of an engine including the ignition control system 10. A typical Hall-effect ignition sensor consists of a Hall-effect sensing integrated circuit and a small permanent magnet molded together in a "U" shaped housing and placed facing each other on opposite sides of the "U" molding. The Hall-effect sensor 12 is placed in the distributor so that a ferrous shutter wheel can be mounted on the distributor cam and passed through the "U" opening of the sensor 12. By cutting openings on the shutter wheel corresponding to the number of cylinders and required duty cycle, input signal 20 is provided containing the timing information for each cylinder required for optimum performance. The input signal 20 from the Hall-effect sensor 12 is a rectangular shaped input signal from which a dual-slope triangular waveform 28 is generated. This shape of waveform facilitates control of dwell time while maintaining the timing information required for proper operation. It is preferred that the integrator circuit 22 incorporate the teachings of Frazee, U.S. patent application Ser. No. 889,152, filed Mar. 22, 1978, "Input Stage for Automotive Ignition Control Circuit", now U.S. Pat. No. 4,163,160 the disclosure of which is hereby incorporated by reference. A specific embodiment of an integrator circuit incorporating the teachings of Frazee will be explained below in connection with FIG. 3. Output line 30 connects an output from integrator circuit 22 to dwell circuit 32. Triangular waveform 28 is generated by integrator circuit 22 in conjunction with capacitor C103 on line 34 and supplied on line 30 to dwell-control circuit 32. Dwell-control circuit 32 is connected to comparator 36 by line 38. The dwell-control circuit 32 generates a dwell-control reference voltage which varies at low engine speeds depending on the triangular waveform 28. Integrator circuit 22 is also connected to comparator circuit 36 by line 40 to supply the triangular waveform 28 to the comparator 36. Comparator 36 compares the dwell-control reference voltage with the dual-slope waveform 28 and produces an output drive-control signal on line 42 connecting the comparator 36 to output drive-control circuit 44. In response to the output drive-control signal on line 42, output drive-control circuit 44 generates an activation signal, which is supplied on line 46 to base 48 of the Darlington pair 18.

The comparator circuit 36 also contains circuit elements for providing a tachometer output on line 50 which can be used as an indicator of engine speed when used to drive a tachometer circuit or other form of speed indicator connected to tachometer modular output terminal P1. Resistor R116 serves to protect the ignition control system 10 from induced high voltage noise on the tachometer line 50.

A voltage regulator 52 is connected to the integrator circuit 22 and the dwell-control circuit 32 by lines 54 and 56, respectively. The voltage regulator 52 is also connected to comparator circuit 36 by line 58, to output drive-control circuit 44 by line 59, and to a stall time-out circuit 60 by line 62. (Each of lines 54, 56, 58, 59, 60 and 62 may comprise more than one line carrying one or more regulated voltages from voltage regulator 52.) The stall time-out circuit 60 is also connected to output drive-control circuit 44 by line 64. The stall time-out circuit 60 prevents excessive power dissipation and consequent heat generation in the ignition control system 10 by shutting off the output drive-control circuit 44 if the engine is not rotating at the time power would otherwise be applied to the ignition coil 16.

Resistors R114, R113 and R101 form an output current limit input threshold (OCLIT) feedback loop, which together with an OCLIT circuit 66 connected between these resistors and dwell control circuit 32 by lines 68 and 70, respectively, serves to connect the Darlington pair 18 and the dwell-control circuit 32 in a feedback loop for current limiting purposes. The output of OCLIT circuit 66 is connected in another feedback loop by line 71 to output drive-control circuit 44.

Resistor R107, connected to output drive-control circuit 44 by line 73 and to voltage source B+ by lines 72 and 74, supplies drive to base 48 of the Darlington pair. Diode CR101 in series with the main battery buss 72 prevents negative going transients of short duration from temporarily affecting performance of the ignition control system 10. Capacitor C101, connected to the main battery buss 72 by line 76, maintains a charge during short duration negative going transients from battery B+, thereby assuring continuous operation of the ignition control system 10. A 20 volt zener diode CR102 limits the maximum voltage supplied on the Hall-effect B+ input line 78 during temporary high voltage excusions caused by field decay transients of various types on the main battery buss 72. This protection is needed since the Hall-effect sensor integrated circuit is rated at 20 volts maximum continuous supply. Resistors R109 and R111 form a voltage-divider network used to set the maximum collector voltage excursion of Darlington pair 18 during ignition firing. Collector clamp circuit 80, in conjunction with the base-emitter voltage BE of the Darlington pair 18, forms the voltage reference of approximately 17 volts across resistor R111. In fabrication, the resistance ratio of R109 to R111 is deliberately set so that the worse case collector voltage will always be higher than the maximum limit after trimming. This insures that only R111 will have to be actively trimmed to force the voltage down. This also implies a conventional cut trim since the voltage across R111 is only 17.0 volts. Since resistor R109 will still have to support approximately 360 volts voltage drop across it, a passive scan cut trim will have to be performed. A minimum resistor length necessary to sustain this much voltage without degradation of performance is required.

In the OCLIT feedback loop of resistors R114, R113 and R101, the voltage developed across R114 is divided by resistors R113 and R101 and compared with the internally generated OCLIT reference voltage. When the voltage across R114 exceeds the OCLIT reference voltage, the OCLIT circuit 66 is activated and forces the output Darlington pair 18 out of saturation. This compensation will continue so as to keep the voltage across R114 constant. This action accomplishes output current limit control. By actively trimming R113 and R101, the same objective current level can always be achieved, despite variations in the sense resistor R114 or reference values.

Resistor R119 and capacitor C106 form a lead-lag compensation network designed to maintain OCLIT loop stability and force a minimum of 45° loop phase margin under worse case gain conditions.

Capacitor C105 is used to generate the time varying dwell-control reference voltage used as a reference signal to the comparator circuit. As indicated previously, capacitor C103 is used to develop the dual-slope waveform 28 which is then compared with the dwell-control reference signal to define the output Darlington pair 18 switch-on point. Capacitor C104 develops a charge across it which is dependent on input duty cycle and is used to modify the charge and discharge current for capacitor C103 as the duty cycle changes. Therefore, compensation of total output on time for various input duty cycles is achieved.

In operation, as the distributor rotates, the Hall-effect sensor 12 provides an output 20 which appears at the module P2 terminal. Output 20 is also represented as Hall signal $V_H$ in FIG. 2. The Hall-effect sensor output stage is an uncommitted collector NPN transistor and typical duty cycle is 75% high (off) to 25% low (on). Spark plug firing must occur during high to low transition of the Hall signal $V_H$. By properly positioning the shutter wheel on the distributor camshaft relative to crankshaft position, proper timing can be achieved.

Figure 2:
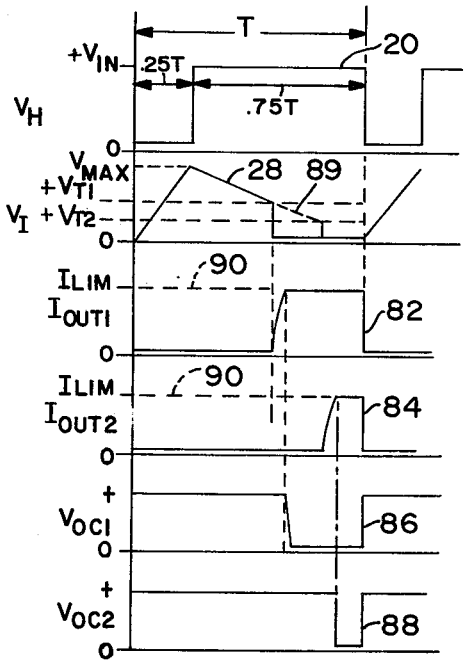
FIG. 2 is a set of waveforms useful for understanding operation of the ignition control system of FIG. 1.

When the voltage of waveform 20 at P2 is low, current flows into capacitor C103, charging it towards some positive voltage level $V_{MAX}$ as shown by waveform 28 which is also shown as voltage $V_1$ in FIG. 2. Since the current into C103 is constant, the magnitude of the voltage $V_1$ reached across C103 will depend on the available charge time or engine speed. Also during the high to low transition of waveform 20, a constant current will flow into C105. This current will build a charge across dwell capacitor C105 constituting the dwell-control reference voltage $V_D$ which is compared with $V_1$ at the comparator circuit 36. A logic condition will prevail which keeps the output current $1_{out}$ to coil primary winding 14 off, as long as $V_1$ exceeds reference voltage $V_D$. After waveform 20 reverts to a high state, capacitor C103 begins to discharge via another current source. The current sources are ratioed such that the charge slope will always be faster than the discharge slope, as long as dwell-control action occurs. Capacitor C105 continues charging while C103 decays towards ground. At the point where voltages $V_1$ and $V_D$ are equal, the output to coil primary 14 will switch on and current begins to flow through the ignition coil 16. At the same time that voltage $V_1$ of the integrator circuit capacitor C103 and voltage $V_D$ of dwell capacitor C105 become equal, the integrator capacitor C103 is reset to ground, thus ensuring that the output of the Darlington pair 18 stays on during the rest of the duration of the input high state. The charge of dwell capacitor C105 is depleted slowly via a discharge current source. From this discussion it follows that the total open loop on-time will depend upon the time it takes the voltage $V_1$ of integrator capacitor C103 to decay to the reference level $V_D$ relative to the total time T between sparks. Therefore the total output drive control circuit 44 on-time will be directly proportional to the charge on the dwell-control capacitor C105.

During current limit, the OCLIT circuit 66 sends a signal $V_{oc}$ to the dwell-control circuit 32 which increases the discharge current of the dwell-control capacitor C105. This discharge current increase lowers the reference level $V_D$ which in turn decreases the overall output on-time. It is this closed loop control which tries to maintain a minimum of on time for OCLIT circuit 66, just sufficient to achieve loop equilibrium. Dwell-control stability depends on integrator and dwell-control current source stability as well as the absolute and temperature variations of C105 and C103. Also, leakage forms a very important parameter of C103, since the integrator operating currents are in the nanoamp range.

Waveforms 82, 84, 86, and 88 in FIG. 2 show the results of controlling dwell time with the system of FIG. 1. Waveform 82 shows the output current $I_{out1}$ from the Darlington pair drive circuit 18 as supplied to the ignition coil primary 14 during the first cycle at engine start up, with no dwell-control function being provided by dwell-control circuit 32. As a result, current $I_{out1}$ is supplied during the entire time $V_1$, as shown by solid line waveform 28, is low. Waveform 86 shows the $V_{oc1}$ signal supplied by OCLIT circuit 66 to the dwell-control circuit 32 on line 70 during the time the $I_{out1}$ signal 82 is at $I_{lim}$ level 90, established by OCLIT circuit 66. In the succeeding cycle, the down slope of waveform 28 is extended by the dwell-control circuit 32 as shown by dashed line 89, in response to the $V_{oc1}$ signal 86. As a result, the dwell time is substantially reduced, as shown by $I_{out2}$ waveform 84. Current $I_{out2}$ is at the $I_{lim}$ level 90 for a substantially shorter time, resulting in a much shorter duration for the $V_{oc2}$ waveform 88. Consequently, less modification of dwell time will occur during the third cycle (not shown).

When the voltage of waveform 20 at P2 changes to a low state the comparator 36 is bypassed and the output is forced into an OFF state. The energy which was stored in the ignition coil primary 14 during conduction is now available in the secondary 126 of the coil 16 to fire the spark plug and accomplish successful burning of the air-fuel mixture in the appropriate cylinder of the engine.

During normal operation, the charge on capacitor C102 is limited by resetting it to ground during the low state of the input waveform 20. During this time the output is kept off by an override circuit which bypasses the integrator circuit 22 and comparator circuit 36. If the input is continuously high, while the ignition key is "on", C102 will begin to charge until such time as to exceed a built in threshold in the stall time-out circuit 60. At this time a signal is sent to the output drive-control circuit 44 which forces the current "off". During time-out, transition of the output drive-control circuit 44 from "on" to "off" must be achieved without generating a spark in the output, or an unstable condition may exist. This is accomplished by limiting the transition time achieved during time out to more than 10 milliseconds. This slow turn off limits the induced secondary output voltage to about 3 KV.

In a specific example, the various resistors, capacitors and diodes shown in FIG. 1 have the values or are of the types shown in the following table.

TABLE

| Component | Value or Type |
|---|---|
| C101 | 0.22μ farad |
| C102 | 0.22μ farad |
| C103 | 0.1μ farad |
| C104 | 1μ farad |
| C105 | 0.22μ farad |
| C106 | 0.1μ farad |
| C107 | 0.22μ farad |
| CR101 | 1N4003 |
| CR102 | IN4747A |
| R101 | 50Ω |
| R104 | 22Ω |
| R107 | 65Ω |
| R109 | 7.7KΩ |
| R111 | 370Ω |
| R113 | 50Ω |
| R114 | 27 milliohm |
| R116 | 2KΩ |
| R117 | 1KΩ |

Figures 3, 3B:
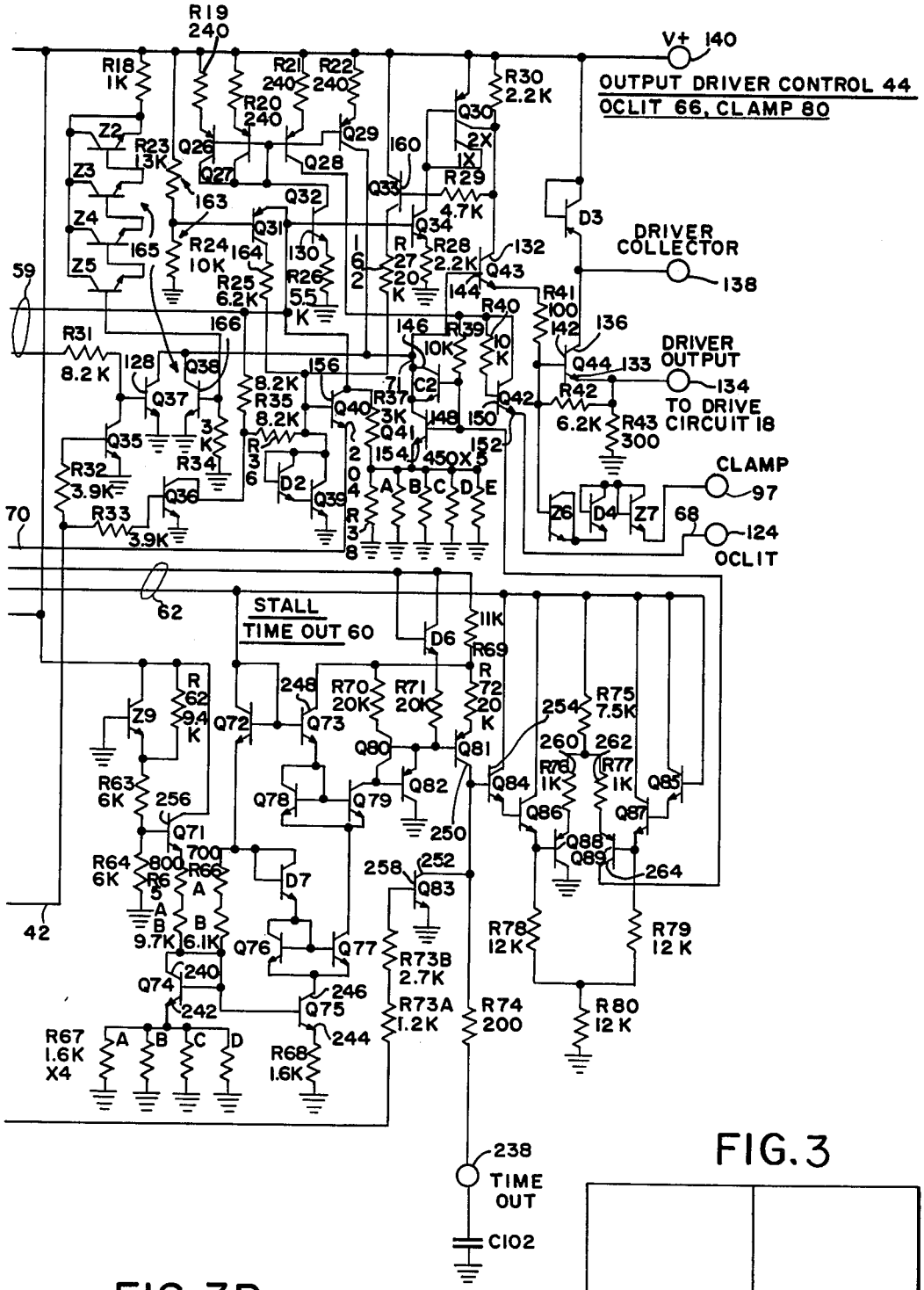
FIG. 3 is a guide for placement of FIGS. 3A and 3B relative to each other.
FIGS. 3A and 3B are a circuit schematic diagram of an embodiment of the invention corresponding to the block diagram of FIG. 1.
Figure 3A:
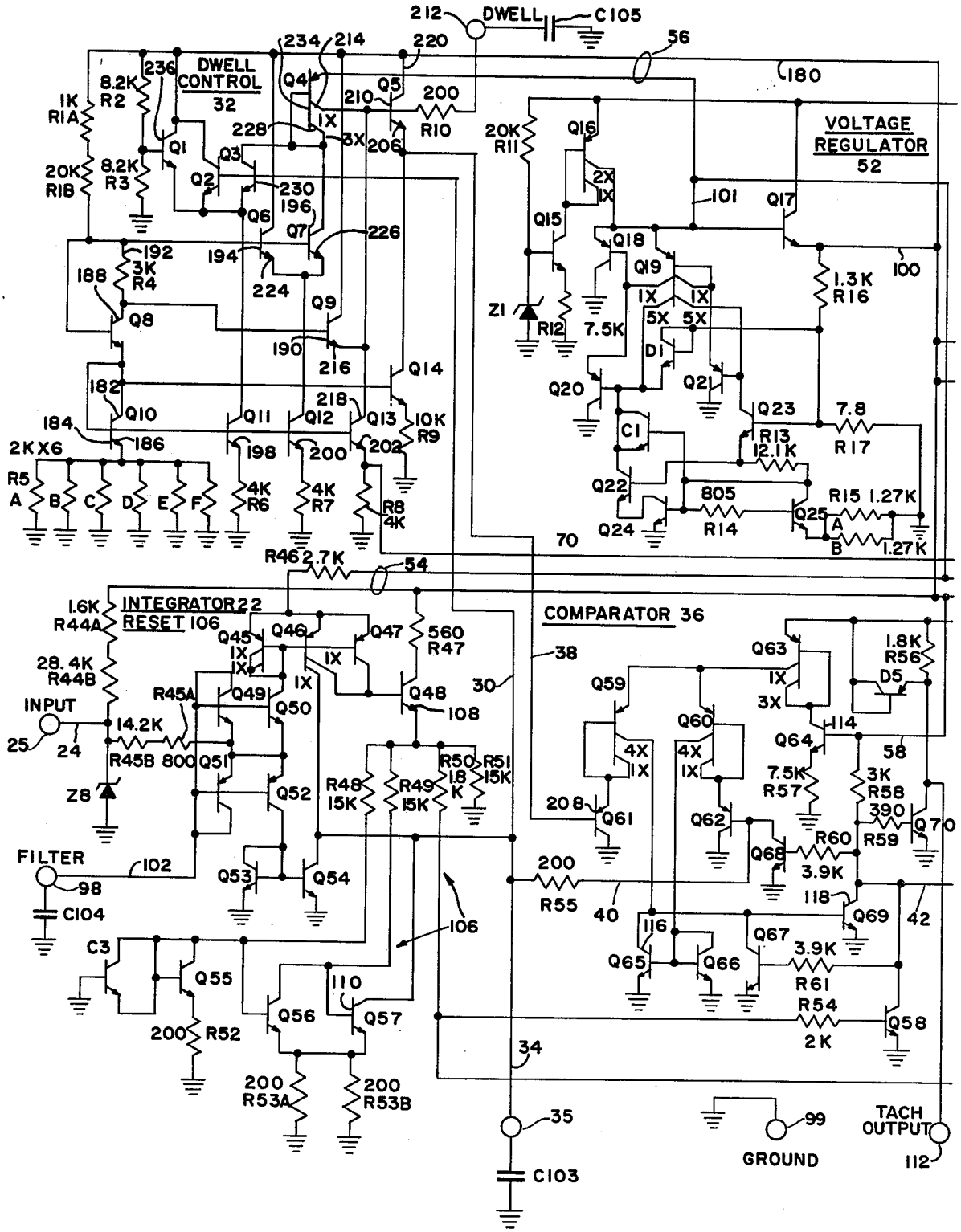

Turning now to FIGS. 3 and 3A–3B, there is shown a detailed circuit diagram of a specific embodiment of the invention corresponding to the block diagram of FIG. 1. FIG. 3 is a guide to placement of FIGS. 3A and 3B in side by side relationship to give the overall schematic in a similar relationship to that shown by the block diagram of FIG. 1. The number next to each resistor in FIGS. 3A and 3B indicates its resistance in ohms. The "X" factors next to the collectors of each multiple-collector transistor indicate the size of the collectors relative to one another. The circuit diagrams of FIGS. 3A and 3B will now be explained as functional elements corresponding to the blocks in FIG. 1.

(1) VOLTAGE REGULATOR 52

The 3-volt regulator 52, which uses a bandgap reference, is a simplified version of the commercially available μA 78L (Y-stepping) circuit, obtainable from Fairchild Camera and Instrument Corporation, Mountain View, Calif. A single transistor Q17 instead of a Darlington pair is used at output 100 to reduce the drop-out voltage by one VBE. A Darlington pair is not required since the total current drain on the regulator 52 is small (less than 10 mA). The start-up circuit used in the Fairchild μA 78L was replaced with a simple resistor R11 feed to a zener diode Z1 which sets up a coarsely regulated current to the reference. Protection circuitry for limiting output current, chip temperature and power dissipation was omitted. The capacitance of an emitter-base diode is used for compensation instead of an MOS capacitor.

The 3-volt regulator 52 is used throughout the ignition control system 10. An output one $V_{BE}$ above the 3-volt output (taken from the base of the output pass transistor Q17) is also used where a slightly higher voltage is required. The 3.7-volt output has a current load of only about 100 μA.

The coarse regulator circuit is comprised of resistors R11 and R12, zener Z1, and transistors Q15 and Q16. Current from the V+ supply (from terminal 140) flows through R11 turning on Z1 which regulates the base voltage of Q15 to 5.8 V. The emitter resistor R12 of transistor Q15, which has 5.1 volts across it, sets the current in Q15 at 680 μA. This current flows in the PNP current mirror Q16 which is scaled for twice the output ($2\times680=1360$ μA). The coarsely regulated current from Q16 flows into the bandgap reference circuit and feedback amplifier which includes the remaining components in the voltage regulator 52.

The emitter area of Q25 is 12 times that of Q24, yet both transistors are operated in a feedback loop which, when stable, supplies equal collector currents (100 μA) in each device. The resulting $V_{BE}$ difference, which is temperature dependent, is impressed across R15 (shown as R15A and R15B), producing a current which also flows in R13. The value of R13 is selected to produce a positive voltage change across it with increasing temperature which exactly matches the negative temperature coefficient of the two VBE's of transistors Q23 and Q24. The result is a temperature independent voltage at the base of Q23. The current in Q23 is mirrored by the multiple emitter lateral PNP Q19 to supply an equal current which flows through Q22 into Q24. Q22 has two functions: (1) it provides a collector voltage to Q24 which approximates that of Q25 for matched operating conditions; and (2) it provides a high output impedance which, in combination with C1, a base-emitter junction capacitor, gives a controlled frequency roll-off for loop stability. Q18 and Q19 are Darlington connected vertical PNP's which shunt unneeded current to ground from the coarse regulator transistor Q16. Pass transistor Q17 and divider resistors R16 and R17 complete the feedback loop. Transistor Q21 is a buffer for the current mirror, and diode D1 prevents a possible latch condition during regulation start up. The regulated 3-volt output is taken from the emitter of Q17 on line 100. A 3.7-volt output is taken from the base of Q17 on line 101.

(2) INTEGRATOR 22 AND RESET CLAMP 106

The up-down integrator 22 is driven from the external Hall-effect pickup 12 (FIG. 1) located in the distributor housing. The down slope of the integrator output waveform 20 (FIG. 2) is compared to the dwell-control reference voltage $V_D$ generated in the dwell-control feedback loop. Spark occurs at the end of the down integration period.

An uncommitted output collector of the Hall-effect pickup 12 connects to the resistor network R44 (shown as R44A and R44B) and R45 at the integrator input, line 24. Zener diode Z8 at the input is for arc protection. Resistors R44 and R45 (shown as R45A and R45B) feed a set of NPN and PNP current mirrors Q49, Q50, Q51 and Q52, respectively. These mirrors in turn feed a second set of NPN and PNP current mirrors, Q53, Q54 and Q45, Q46, respectively. The outputs from the second set of mirrors are connected and applied to the external integrating capacitor C103 on line 34.

The first set of current mirrors Q49–Q52 are decoupled by the external filter capacitor C104 on line 102.

The filter capacitor C104 blocks DC (direct current), thus ensuring that the amplitudes of the up and down integrations are the same regardless of the duty cycle from the Hall-effect sensor 12. The ratio of resistors R44 and R45 are selected so that the charge on the filter capacitor C104 is one-half of the 3-volt regulated supply on line 100 with a nominal duty cycle (75% of the period high at the input). The temperature coefficients of the IC resistors R44 and R45 are approximately compensated by the temperature dependence of input diodes Q49 and Q51 of the first set of current mirrors. The integrator output amplitude is therefore relatively insensitive to chip temperature changes.

The second PNP current mirror Q45, Q46 and Q47 has additional outputs from transistors Q46 and Q47 which feed through buffer transistor Q48. Resistor R47 in the collector of Q48 causes Q48 to saturate with a resulting base potential which is sufficiently low to keep Q47 out of saturation, thus preventing disruption of the mirror action between transistors Q45 and Q46.

Buffer transistor Q48 feeds reset clamp 106, the comparator 36 and the stall time-out circuit 60 during the up-slope of the integrator 22. The reset clamp, comprised of R48, R49, R52, R53 (shown as R53A and R53B), C3, Q55, Q56 and Q57, operates if the integrator waveform 28 is not clamped to ground by the comparator 36 before the end of the down integration period. This condition, called "missing pulse operation" can occur under rapid engine acceleration during start-up. If the integrator signal $V_I$ has not returned to ground potential by the end of the down integration period, the reset clamp 106 will discharge the integrator capacitor C103 at the beginning of the up integration period, thus resetting the integrator 22 for normal operation, eliminating the possibility of a series of "missing pulses".

The reset clamp 106 operates as follows: Before the up integration period, Q48 is OFF and its emitter 108 is connected to ground potential through resistor R51. At the beginning of the up integration period, Q48 turns base 110 of Q57 on instantaneously through resistor R49 since Q55 and Q56 turn-on is delayed by the time constant of junction capacitor C3 and resistor R48. Discharge current in the external integrating capacitor C103 flows through Q57 into resistor R53, raising the emitter voltages of Q56 and Q57. Q56 is kept OFF even through C3 quickly charges, bringing the diode-connector transistor Q55 into conduction. When the integrator capacitor C103 is almost totally discharged by Q57, the emitter voltage on Q56 and Q57 decays to a sufficiently low level to cause Q56 to conduct. Q56 has twice the emitter area of Q55. The emitter resistor R52 of Q55 is half the value of R53 in the emitter of Q56. The effect under steady state conditions is for Q56 to saturate and hold Q57 OFF for the remainder of the up integration period.

Buffer transistor Q48 drives the comparator 36 and stall time-out circuitry 60 through resistors R50, R54 and R73 (shown as R73A and R73B) during the up integration period.

(3) COMPARATOR 36 AND TACH OUTPUT 112

The comparator input stage is a standard configuration used in a variety of commercially available linear integrated circuits. The inputs to the comparator 36 are through vertical PNP buffer transistors Q61 and Q62 which feed split collector PNP current mirrors Q59 and Q60, respectively. Current to the differentially connected input pair Q59 and Q60 is supplied by current mirror Q63 which is driven from Q64. The base 114 of Q64 is regulated at 3 volts so that 2.3 volts appears across emitter resistor R57 thus setting the current in Q64.

The outputs from the differentially connected transistors Q59 and Q60 feed into current mirror Q65 and Q66. The collector 116 of Q65 drives the single ended output transistor Q69 which has a load resistor R58 connected through collector 118 to the regulated 3-volt line 100.

At the beginning of the down integration period, Q58 is turned OFF by Q48 and the comparator output from the collector 118 of transistor Q69 on line 42 is free to respond to its inputs. Depending on engine speed and battery voltage, the dwell-control voltage $V_D$ to the comparator 36 may be above or below the peak value $V_{MAX}$ of the integrator voltage $V_I$. If $V_D$ is higher than the peak $V_{MAX}$, as will be the case at high engine speeds, the comparator output 118 will immediately go high at the beginning of the down integration period, giving maximum dwell time. Values of control voltage $V_D$ at lower engine speeds will be below the peak value of the integrator signal $V_I$, which will delay the high output from the comparator 36, thus reducing the percentage dwell time.

When the comparator output 118 goes high, the load resistor R58 in the collector 118 of Q69 supplies current through R59, R60, R61, R32 and R33 to the bases of transistors Q70, Q68, Q67, Q35 and Q36, respectively, to saturate these five devices. Q70 is the tachometer output transistor with collector load resistor R56 connected to V+ potential. The tachometer output signal at terminal 112 is low during the dwell period prior to spark. Diode D5 between the tachometer output terminal 112 and V+ potential is included for protection against static discharges into the tachometer output terminal. Q68 discharges the integrator capacitor C103 at the beginning of the dwell period and clamps it to ground potential for the remainder of the dwell period. Q67 latches Q69 OFF, holding the comparator output high during the remainder of the dwell period regardless of the comparator input conditions.

(4) OUTPUT DRIVER CONTROL 44, OCLIT 66, LOAD DUMP 165 AND CLAMP 80

The output driver control 44 responds to the output from the comparator 36, driving the Darlington pair drive circuit 18 into saturation at the beginning of the dwell period, putting full battery voltage across the inductive coil load 14 at the Darlington collector 120 (FIG. 1). A resistor network R101, R113 and R114 in the emitter 122 of the Darlington pair 18 senses the rise in current in the inductive load 14 and a voltage from this network is applied to the OCLIT terminal 124 of the linear integrated circuit (LIC). When the OCLIT voltage reaches a 100 mV threshold established within the LIC, the OCLIT circuitry 66 reduces the drive to the Darlington 18, taking it out saturation and holding the coil current constant for the remainder of the dwell period. The resistor network R120, R121, R113 and R114 is trimmed for a coil current limit of 7.5 A. At the end of the dwell period, the Darlington 18 is turned OFF and the stored energy in the coil primary 14 produces a high voltage firing pulse in the coil secondary 126 (FIG. 1).

Operating details of the output driver control 44 are as follows: The output 118 on line 42 from the comparator 36 saturates Q35 during the dwell period. The current in load resistor R31 is diverted from base 128 of Q37 into ground through Q35 turning OFF Q43. Current from PNP current source Q29 then flows into the base of predriver transistor Q43 saturating it and the output driver transistor Q44, which is driven from the emitter of Q43 through resistor R41. The current from Q29 is from the current mirror transistor set Q26, Q27, Q28 and Q29 with degeneration resistors R19, R20, R21 and R22, respectively. The degeneration resistors R19–R22 raise the output impedance of the current mirror Q26–Q29, making its output insensitive to V+ potential variations. The current in the mirror Q26–Q29 is set up by transistor Q32. Base 130 of Q32 is regulated at 3 volts, producing 2.3 volts across the current setting resistor R26, which connects between the emitter of Q32 and ground.

The load for collector 132 of Q43 has three components:

(1) a resistor R30 which connects to V+ potential, (2) a resistor R29 which connects to the base of Q33 and (3) the output from the PNP current mirror Q30.

The major current into Q43 is supplied through R30, but at low temperatures and low battery voltage, additional current is needed through Q43 into Q44 to drive the Darlington 18 into full saturation. The extra current required is supplied from Q30. The current into current mirror Q30 is set up by transistor Q34 and emitter resistor R28 in the same way that current was set up for current mirror Q26–Q29.

Emitter 133 of output transistor Q44 drives the external Darlington 18 through terminal 134. An external load resistor R107 (FIG. 1) for Q44 is provided because its power dissipation is too high to be contained within the LIC. The external resistor R107 is connected to collector 136 of Q44 through terminal 138.

A high current diode D3 is connected between terminal 138 and V+ potential terminal 140. The diode D3 protects the LIC by clamping the potential on the driver collector 136 to one diode drop above the V+ potential if a positive transient voltage appears on the battery side of the external load resistor R107 connected to terminal 138.

A resistor R42 is connected between base 142 and emitter 133 of Q44, providing a leakage path for Q43 and Q44 to ensure that Q44 turns fully OFF at high temperatures when base drive is removed from Q43. Resistor R43 between terminal 134 and ground likewise provides a leakage path from the Darlington input to ground to ensure that it also turns fully OFF when driver Q44 is OFF.

The 100 mV reference for the OCLIT circuit 66 is established at the junction of resistors R37 and R38 (shown as R38A, R38B, R38C, R38D and R38E), connected between the 3-volt reference at 100 and ground. In addition to the current through R37 into R38, current from the current mirror transistor Q29 also flows through Q41 into R38 when the OCLIT loop is operating. The current from the current mirror Q26–Q29 is controlled by the voltage across R26, which has a positive temperature coefficient (TC) due to the temperature characteristic of the base-emitter junction of Q26. The result of the temperature dependence of the current through Q41 into R38 is to produce an OCLIT reference voltage with a slightly positive TC which compensates for the positive TC of the external sense resistor network R120, R121, R113 and R114 used in the emitter 122 of the external Darlington output circuit 18.

When the current in the external Darlington output circuit 18 is low, the potential at the OCLIT terminal 124 is below the OCLIT reference voltage and all of the current from Q28 of the PNP current mirror Q26–Q29 flows through Q42 out of the OCLIT terminal 124. As the Darlington output circuit 18 current increases, the OCLIT voltage rises until it reaches the OCLIT reference voltage. At this potential, Q41 is brought into conduction by application of the collector voltage of Q42 through R39 to the base of Q41. Collector current into Q41 diverts current away from base 144 of the predriver, Q43, thereby controlling the amount of drive current available from the output driver Q44. The OCLIT feedback loop is thus closed and the Darlington current is held constant for the remainder of the dwell period.

Resistor R39 in series with the input to Q41 and junction capacitor C2 between collector 146 and base 148 of Q41 form a low-pass filter for high-frequency stabilization of the OCLIT feedback loop. Resistor R40 is included in base 150 of Q42 to match resistor R39 in base 148 of Q41 for minimum offset between the OCLIT voltage at emitter 152 of Q42 and the OCLIT reference voltage at emitter 154 of Q41.

Transistor Q40 is a driver for the dwell-control circuitry 32. Q40 is held ON except when the OCLIT loop is closed. Prior to the dwell period, the comparator output of the comparator 36 at the collector 118 of Q69 is low. The voltage on base resistor R33 of Q36 is low and Q36 is held OFF. Current through R35, which connects to the 3-volt regulated supply on line 100, flows through R36 into base 156 of Q40 turning Q40 ON. The voltage rise on the base of Q40 is clamped at two diode drops (1.4 V) by the Darlington-connected diode D2 and Q40, connected between the base 156 of Q40 and ground.

During the dwell period the output of comparator 36 is high. Base 158 of Q36 is turned ON by the comparator output voltage applied through R33. Q36 saturates, clamping the junction of R35 and R36 to ground. Because Q43 is fully turned on at the beginning of the dwell period before the OCLIT circuitry 66 operates, Q43 saturates and its collector is about 3 volts (the sum of the Darlington $V_{BE}$, the $V_{BE}$ of Q44 and the VBE of Q43) above ground. Transistor Q33 is turned on by the current out of its base 160, through R29, into the saturated collector 132 of Q43. Q33 saturates pulling upper end 162 of resistor R27 to the V+ supply. Current through R27 flows into R36 which develops a voltage at their junction and the base of Q40 which turns Q40 ON. Again the maximum voltage at the base 156 of Q40 is clamped at 1.4 volts by D2 and Q39. When the OCLIT circuit 66 comes into operation, the current in the predriver Q43 is drastically reduced to less than that available from current mirror Q30. Q43 comes out of saturation and the output of current mirror Q30 saturates. The voltage thus applied to the base 160 of Q33 through resistor R29 is below the VBE threshold of Q33 and Q33 turns OFF. The current in R27 drops to zero and Q40 is turned OFF since its base voltage, established through R36, is held low by saturated transistor Q36.

At low battery voltages there is insufficient current flowing out of the base of Q33 to hold it on even though the OCLIT circuit 66 does not come into operation at low supply voltages (below about 7 volts). To prevent Q40 from being OFF at low battery conditions, even though the OCLIT loop is not operating, circuitry 163 associated with Q31 was added. A resistor divider R23 and R24 is connected between V+ potential and ground. The junction of this divider R23 and R24 connects to the base of Q31 and the emitter of Q31 is regulated at 3 volts. When the V+ potential drops below 5.3 volts, the potential at the junction of R23 and R24 drives the base of Q31 ON. Q31 saturates and the top end 164 of resistor R25 is connected to the 3-volt regulated supply on line 100. The current through R25 flows into R36, developing sufficient voltage at the base of Q40 to turn it ON.

A load dump circuit 165 shuts down the external Darlington transistor circuit 18 when the supply voltage exceeds 30 V. The zener diode string Z2, Z3, Z4 and Z5 is connected between the V+ supply through current-limiting resistor R18 to base 166 of Q38. Resistor R34 between the base of Q38 and ground provides a leakage path, so that any leakage through the zener diode string Z2–Z5 will not turn Q38 ON. When sufficient voltage appears on the V+ line (terminal 140) to break down the zener string Z2–Z5, Q38 is turned ON shutting down Q43, Q44 and the external Darlington 18.

(5) DWELL CONTROL

The dwell-control circuitry 32 along with the comparator 36 and output control circuitry 44 form a feedback loop which controls the OCLIT on time. The dwell-control circuit 32 has two inputs:

(1) an OCLIT sense signal on line 70 derived in the output stage 44 which is high except when the OCLIT 66 is operating and (2) the output signal 28 on line 30 of integrator 22.

The dwell-control output $V_D$ on line 38 drives the reference input to the comparator 36. Since reference voltage $V_D$ is taken from emitter 206 of transistor Q5 while the voltage at terminal 212 from dwell capacitor C105 is applied to the base of transistor Q5 as shown in FIG. 3A, the dwell capacitor voltage at terminal 212 is about one $V_{BE}$ greater than dwell-control reference voltage $V_D$.

Figure 7:
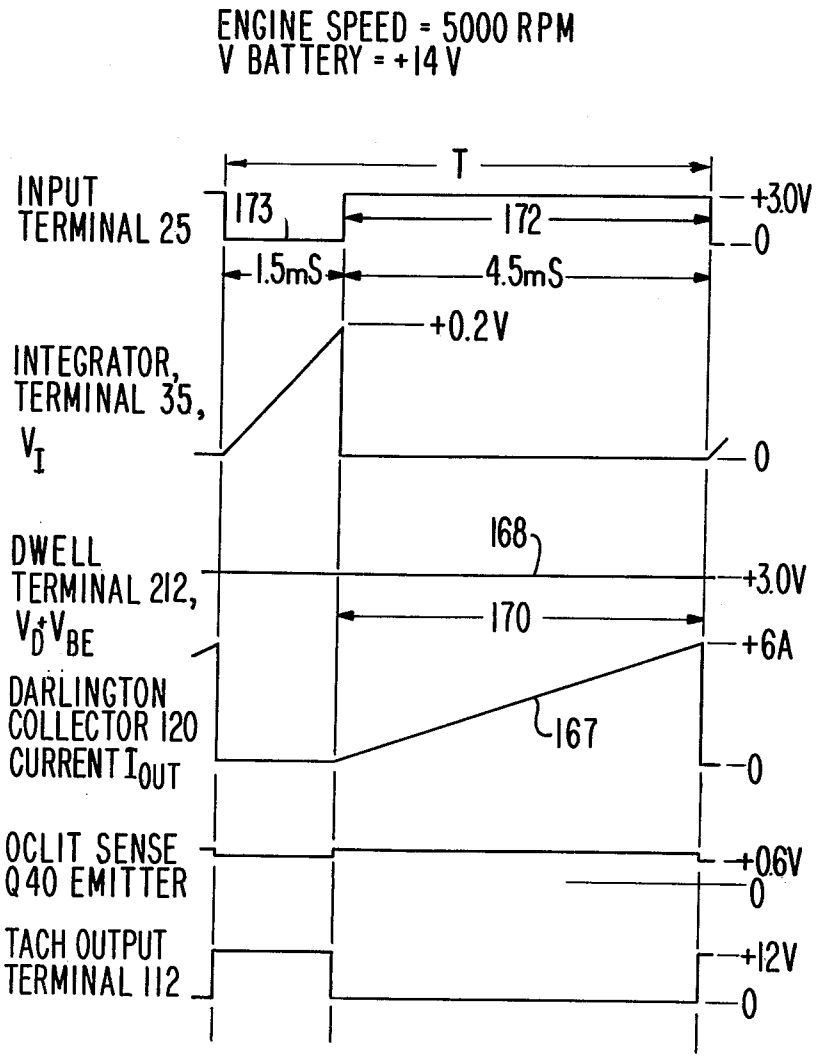

Operation of the dwell-control loop is most easily described by looking at what happens at various engine speeds, most easily understood by reference to the waveform diagrams of FIGS. 4–7:

(A) At very high engine speeds there is insufficient dwell time available for the coil current 167 from collector 120 of Darlington pair 18 to build up to where the OCLIT circuit 66 would come into operation. As shown in FIG. 7 the dwell control 32 responds by sending a maximum voltage output 168 to comparator reference at Q61. This results in a dwell time 170 which is maximum and which is coincident with the high period 172 of the Hall effect input signal 173 at terminal 25.

Figure 6:
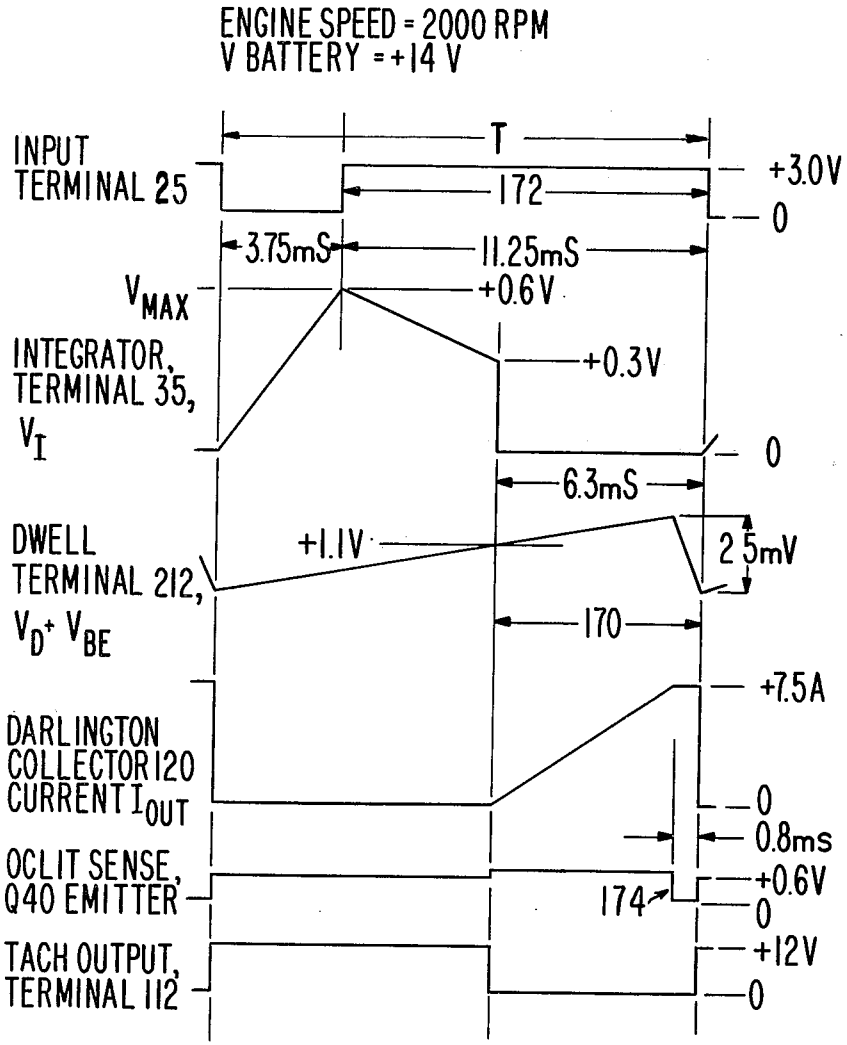

(B) At intermediate engine speeds the OCLIT ON time is controlled as a percentage of the total period between firings as indicated in FIG. 6. The output voltage $V_D$ from the dwell control 32 decreases to reduce the dwell period 170 to a time which is just sufficient to bring the OCLIT circuit 66 into operation for about 6% of the total period, as indicated at 174.

Figure 5:
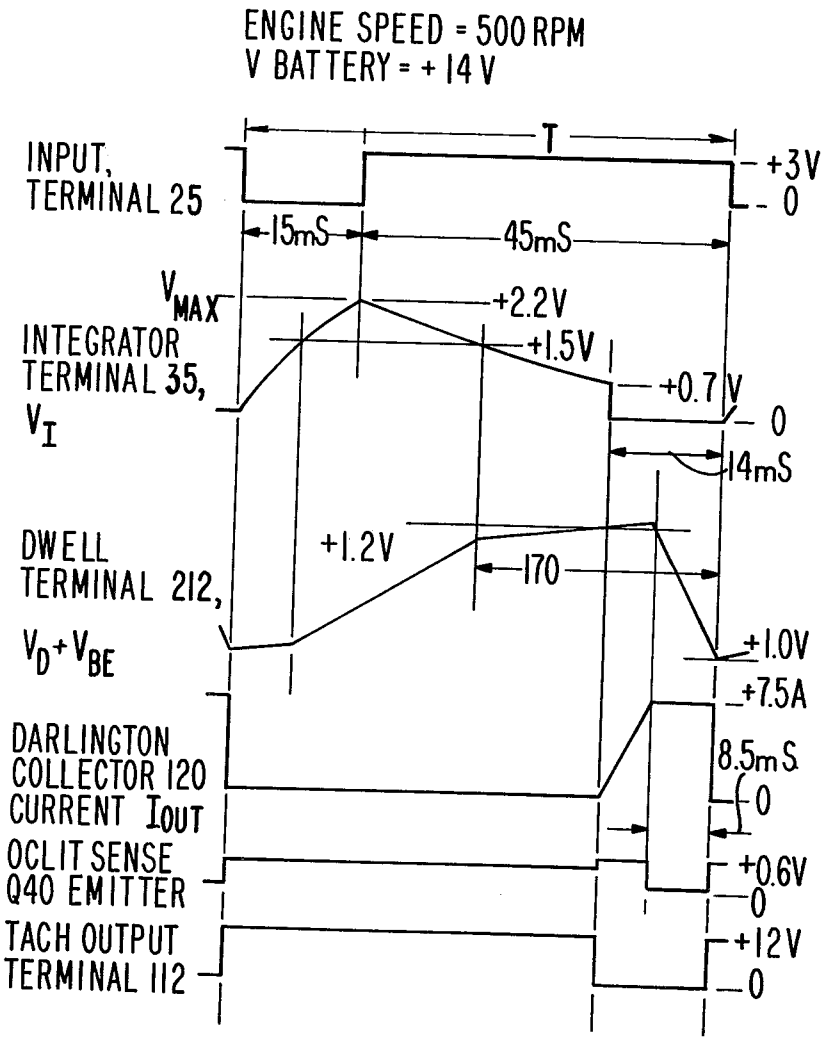
FIGS. 4–7 are waveform diagrams showing operation of the system in FIGS. 3A and 3B at different engine speeds.

(C) At high cranking and low idle speeds, as shown in FIG. 5, the dwell period 170 is extended to permit coil current build-up under acceleration where each period is shorter than the last. The required increase in dwell time 170 is inversely related to engine speed; the greatest percentage change from one period to the next occurs at the lower speeds as the engine accelerates. Increased dwell time at low engine speeds is accomplished by utilizing an increasing amplitude of voltage $V_{MAX}$ of the integrator output signal $V_1$ with decreasing speed.

Figure 4:
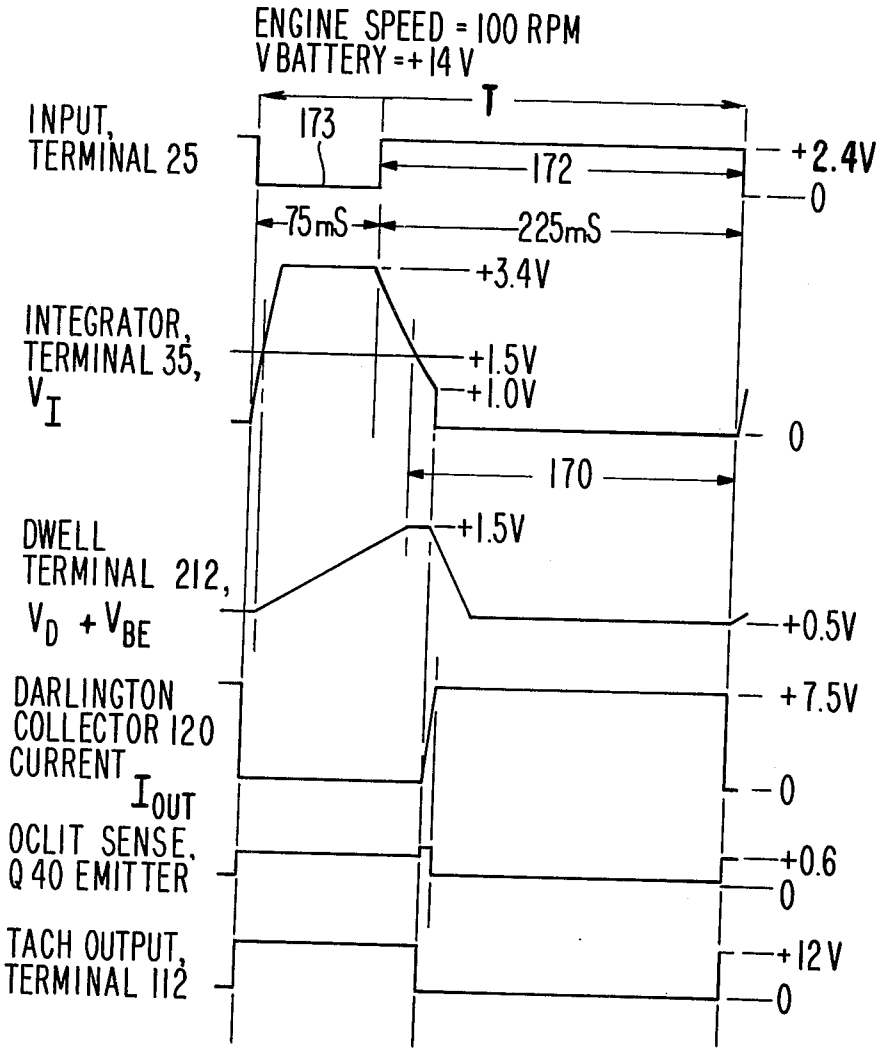

(D) At low cranking speeds the integrator signal $V_1$ is limited by the dynamic range of the integrator 22. The dwell-control loop is ineffective and the dwell period 170 tends to follow the high period 172 of the Hall-effect input signal 173 as shown in FIG. 4.

A detailed circuit description of the dwell control circuit 32 follows:

Several current sinks are used in the dwell control 32. These are established in a current mirror comprised of Q10, Q11, Q12, Q13 and Q14. Current is set up in diode-connected transistor Q10 and is mirrored in Q11–Q14. The path for current into Q10 is from the 3-volt regulated line 180 (which is one of lines 56) into R1 (shown as R1A and R1B), through diode-connected transistor Q8 into collector 182 and base 184 of Q10. Current flows out of emitter 186 of Q10 through degeneration resistor R5 (shown as R5A, R5B, R5C, R5D, R5E and R5F) into ground. The current into Q10 is relatively insensitive to chip temperature changes because the positive TC of resistor R1 is compensated by the negative voltage TC of diode-connected transistors Q8 and Q10. A load resistor R4 in collector 188 of Q8 is used to develop a voltage at the collector of Q8 which sets the voltage at base 190 of clamp transistor Q9. A voltage from top 192 of R4 is used to bias bases 194 and 196 of current splitting transistors Q6 and Q7, respectively.

Transistor Q10 has an emitter area which is 12 times the emitter area of each of the transistors Q11 through Q14. Degeneration resistors R6, R7 and R8 in emitters 198, 200 and 202, respectively, of Q11, Q12 and Q13, respectively, are 12 times the resistance of degeneration resistor R5 in the emitter 186 of Q10. Q11, Q12 and Q13 thus operate at the same current density as Q10 for good temperature tracking and their sink currents are each one-twelfth of the current through Q10. Q14 has an emitter degeneration resistor R9 of higher resistance and operates at a lower current than Q11, Q12 and Q13. The emitter 202 of Q13 connects to emitter 204 of the OCLIT sense output transistor Q40. When Q40 output is high, the current sink Q13 is turned OFF.

Current sink Q14 connects to emitter 206 of the dwell-control output buffer transistor Q5 and by line 38 to base 208 of Q61. It provides current loading for Q5 and also supplies base current to the input transistor Q61 of the comparator 36. Base 210 of buffer transistor Q5 connects to (1) the external dwell capacitor C105 through R10 and terminal 212, (2) output 214 of current mirror Q4, (3) emitter 216 of clamp transistor Q9, and (4) collector 218 of current sink Q13.

The charge on the dwell capacitor C105, and thus the output voltage $V_D$ from the dwell control 32, depends on the charge current which flows from output 220 of the current mirror Q5 and the discharge current which flows into current sink transistor Q13. The current from current mirror Q5 is established by the sum of the currents which flow in Q3 and Q7, which connect to input 234 of current mirror Q4. Transistor Q6 has 5 times the emitter area of Q7. Because the bases 194 and 196 and emitters 224 and 226 of transistor Q6 and Q7, respectively are connected in parallel, the current which flows in Q7 is one-sixth the total current which flows into current sink Q12. The current mirror Q4 has a 3 to 1 reduction because the collectors 228 and 214 are scaled by this ratio. The current into current sink Q12 is therefore 18 times the current which flows in Q4.

Transistors Q2 and Q3 also act as current splitters similar to transistor pair Q6 and Q7. However, Q3 has 3 times the area of Q2 so that the current in Q3 is three-fourths the current which flows into current sink Q11. The current in Q3 is mirrored to one-third its value at output 220 of Q5. Q3 and Q4 conduct only when the integrator input signal into their bases 230 and 234, respectively, exceeds the voltage on base 236 of Q1, which is established by the resistive divider R2 and R3 connected between the 3-volt regulated supply on line 180 and ground. When the integrator amplitude on line 30 from integrator 22 and integrating capacitor C103 is below the potential on base 236 of Q1, the current into Q11 flows from the 3-volt supply through Q1 and both Q3 and Q4 are OFF.

At intermediate engine speeds, when the peak value of the integrator signal on line 30 is less than the voltage on the base 236 of Q1, the charge current for the dwell capacitor on line 30 is due only to the current into current sink Q12 which is 18 times the charge current. The discharge current into Q13 is also 18 times the charge current. Since the charge current is 5.6% of the discharge current, the discharge period (on time of OCLIT circuit 66) must be 5.6% of the total period 2 for charge on the dwell capacitor C105 to be in equilibrium. The 18 to 1 ratio of charge to discharge current in the dwell capacitor C105 thus sets the OCLIT ON time.

At lower engine speeds, the integrator signal on line 30 increases in amplitude and turns Q2 and Q3 ON for the portion of the period that the integrator signal exceeds the potential on the base 236 of Q1. Conduction of Q3 produces an extra charge current which flows from current mirror Q4. The ratio of discharge to charge current is reduced, thus increasing the percentage of OCLIT ON time and therefore the dwell time. Clamp transistor Q9 limits the negative-going voltage excursion of the dwell capacitor C105 to minimize the recovery time of the dwell-control loop during low speed acceleration.

(6) STALL TIME-OUT CIRCUIT 60

To prevent excessive temperature rise in the module, the stall time-out circuit 60 shuts down the external Darlington output circuit 18 after a period of time if the ignition is ON and the engine is stalled with a high signal at the Hall effect input 24. The time-out period is a function of battery voltage B+ and is sufficiently long that it exceeds the period between firings even at the lowest expected cranking speeds. Since the time-out circuit is reset at the beginning of each low state of the Hall-effect input signal H, the time-out circuitry 60 has no effect on overall module operation at cranking speeds or above.

At the end of the time-out period, the external Darlington circuit 18 is turned OFF slowly to prevent a false spark being generated at this time.

The time-out circuitry consists of four basic parts:

(1) an external time-out capacitor C102 connected at terminal 238, (2) a supply voltage dependent current source which charges the time-out capacitor C102 at a controlled rate, (3) a reset transistor Q83 and (4) a comparator with a 3-volt reference which shuts off the external Darlington drive circuit 18 by driving the OCLIT circuitry 66 when the time-out capacitor C102 charges to 3 volts.

A detailed description of each part of the time-out circuit 60 follows:

When battery voltage B+ is low (below about 7 volts), the charge current for the time-out capacitor C102 is derived from current mirrors, and current splitting transistors connected to the 3-volt regulated supply 100 from voltage regulator 52.

The first mirror in the charge current supply consists of diode-connected transistor Q74 and sink transistor Q75. The current for Q74 flows from the voltage regulator 52 through diode-connected transistor Q72 through R66 (shown as R66A and R66B) into collector 240 of Q74. Current flows out of emitter 242 of Q74 through degeneration resistor R67 (shown as R67A, R67B, R67C and R67D) to ground. The current into Q74 is relatively insensitive to temperature since the positive TC of resistor R66 is compensated by the negative TC of the diode voltages of diode-connected transistors Q72 and Q74. The emitter area of Q74 is 4 times the emitter area of Q75. The degeneration resistor R68 in the emitter 244 of Q75 is 4 times the value of emitter degeneration resistor R67. Q74 and Q75 thus operate at equal emitter current density for good temperature tracking, and the current in Q75 is one-fourth the current in Q74.

Current into collector 246 of current sink Q75 flows through current-splitting transistors Q76 and Q77. The VBE voltage drops in Q72 and D7, which connect Q76 to the 3-volt regulated supply 100, roughly match the VBE voltage drops in Q73 and Q78, which bias the collector of Q77. The collector-to-base voltage of transistor Q77 is therefore roughly zero which matches the zero collector-to-base voltage of Q76. Q76 and Q77 thus operate under matched biasing conditions. The emitter area of Q76 is 10 times the emitter area of Q77. The collector current which flows in Q77 is therefore one-eleventh of the current which flows in Q75. Q75 becomes a current sink for current-splitting transistors Q78 and Q79 which operate in an identical fashion to Q76 and Q77. Q78 has 10 times the emitter area of Q79 so Q79 operates at one-eleventh the current in Q77. Transistor Q79 operates a second current mirror Q80 and Q82 with emitter degeneration resistors R70 and R72, respectively. Q82 is a buffer transistor which provides base drive to current mirror Q80 to minimize the effect of low beta on the mirroring accuracy between Q80 and Q81. The upper end emitter degeneration resistors R70 and R72 are connected to a 3.7-volt supply via R69. The 3.7-volt supply on line 101 (one VBE above the 3-volt regulated supply 100) is used to bias mirror Q80 and Q81 so that Q81 can charge the time-out capacitor C102 to 3 volts without saturating. A load current for the mirror buffer transistor Q82 is set up from the 3.7-volt supply 101, through diode D6 and resistor R71 to the emitter of Q82. The voltage drop across D6 tracks VBE drops in Q80 and Q81 over temperature to maintain a relatively constant current in R71. The current through R69, which flows into collector 248 of Q73 and into emitter degeneration resistors R70 and R71, develops a voltage drop across R69 which compensates for the higher VBE in the NPN diode-connected transistor D6 compared to the VBEs of transistors Q80 and Q81. The collector output 250 of current source Q81 is connected to the time-out capacitor C102 through R74 and terminal 238, to collector 252 of reset transistor Q83, and to the input of the comparator, i.e., base 254 of Q84.

At higher battery voltage B+, the divider resistors R62, R63 and R64 connected between the V+ supply at terminal 140 and ground are used to increase the current into current mirror Q74 and Q75 and therefore the charge current from Q81 into the time-out capacitor C102. When the battery voltage B+ is raised above about 7 volts, the voltage at the junction of R63 and R64, which connects to base 256 of Q71, becomes sufficiently high to turn Q71 ON and deliver current through Q71 and R65 into the collector 240 of Q74. As the supply voltage B+ is increased, the voltage on the base 256 of Q71 rises and the current through Q71 and R65 increases until the voltage at the junction of R26 and R63 in the divider is clamped at the zener breakdown voltage of zener diode Z9. For any further increase in supply voltage, Z9 will prevent an increase in time-out charge current. The threshold for conduction in Z9 occurs at a battery voltage B+ of about 14 volts.

Base 258 of the reset transistor Q83, which discharges the time-out capacitor C102, is driven from the emitter 108 of Q48 through resistors R50 and R73. It is turned ON during the period when the Hall effect input $V_H$ is low.

The time-out comparator consists of three sets of differentially connected transistor pairs: Q84-85, Q86-87 and Q88-89. The Darlington connected input transistors Q84 and Q86 provide a high input impedance for minimum current loading on the time-out charging circuit. The input to the matching Darlington Q86 is referenced to the 3-volt voltage regulator 52. The differential output transistors Q88 and Q89 have emitter degeneration resistors R76 and R77, respectively, to control the gain of the comparator. R75 connects between the voltage regulator 52 and the tops 260 and 262 of resistors R76 and R77, respectively to bias the differential output pair. The input Darlingtons are biased through resistors R78 and Q79 into R80 to ground.

The time-out comparator output is single-ended from collector 264 of Q89. It connects to the base 148 of Q41 in the OCLIT circuitry 66. When the voltage of timeout capacitor C102 increases through 3 volts, output current flows from the collector 264 of Q89 into the base 148 of Q41. Q41 turns ON, removing base drive from Q43, thus turning Q43, Q44 and the external Darlington drive circuit 18 OFF. The turn-off rate of the external Darlington circuit is sufficiently slow so that stored energy in the coil primary 14 is dissipated in the Darlington 18 during turn-off and high voltage is not developed at the coil secondary 126.

It should now be apparent to those skilled in the art that an ignition control system capable of achieving the stated objects of the invention has been provided. By providing a tighter feedback control loop for dwell time, an ignition control system more responsive to changes in operating conditions than prior art ignition control systems is provided. The result is a set of drive pulses for the ignition coil primary which more closely follow the optimum characteristics required for most efficient engine operation than obtainable with mechanical breaker points or prior art electronic ignition control systems. The system thus can meet more stringent control requirements now required to meet demands for increased fuel economy and pollution control in internal combustion engines.

It should further be apparent to those skilled in the art that various changes in form and details of the invention as described above may be made. It is intended that such changes be included within the spirit and scope of the claims appended hereto.

What is claimed is:

1. An ignition control system for connection between (1) sensing means for repetitively producing a timing signal in response to rotation of distributor means and (2) output drive means responsive to a repetitively generated activation signal for repetitively supplying an ignition signal to activate ignition means at the repetition period of the ignition signal, the ignition control system comprising:

integrating means responsive to the timing signal for producing a waveform;

dwell-control means for producing a dwell-control reference signal;

comparing means responsive to the waveform and to the dwell-control reference signal for producing an output drive-control signal when the voltage of the waveform equals or is less than the voltage of the dwell-control reference signal;

output drive-control means responsive to the output drive-control signal for generating the activation signal to activate the output drive means;

first feedback means responsive to an output signal indicative of the operational state of the output drive means for supplying a first feedback signal to the output drive-control means to cause the output drive means to stabilize temporarily at a selected activated operational state; and second feedback means responsive to the output signal for supplying a second feedback signal to the dwell-control means to control the voltage level of the dwell-control reference signal and thereby to control the length of dwell time during which the output drive means is activated prior to generation of the ignition signal.

2. An ignition control system as in claim 1 wherein the waveform is a dual-slope waveform.

3. An ignition control system as in claim 2 wherein the time during which the output drive means is at the selected activated operational state is a selected percentage of the repetition period over a selected first range of the repetition period.

4. An ignition control system as in claim 3 wherein the selected activated operational state is represented by a selected current level for the ignition signal and wherein the first feedback means comprises a current limiting circuit which acts to limit the current of the ignition signal to the selected current level during the time when the output drive means is at the selected activated operational state.

5. An ignition control system as in claim 2 or 4 wherein the integrating means comprises an integrating capacitor, charging of which produces a first slope of the dual-slope waveform and discharging of which produces a second slope of the dual-slope waveform.

6. An ignition control system as in claim 5 wherein the dwell-control means comprises a dwell-control capacitor.

7. An ignition control system as in claim 2 or 4 wherein the dwell-control reference signal varies in response to the dual-slope waveform over a selected second range of the repetition period.

8. An ignition control system as in claim 1 wherein the timing signal substantially comprises a first value for a portion of the repetition period and a second value for the remainder of the repetition period and wherein the integrating means comprises an integrating capacitor, charging of which during said portion of the repetition period produces a first slope of the waveform and discharging of which during said remainder of the repetition period produces a second slope of the waveform.

9. An ignition control system as in claim 8 wherein the dwell-control means comprises a dwell-control capacitor, charging of which produces a signal substantially linearly related to the dwell-control reference signal.

10. An ignition control system as in claim 9 wherein the time during which the output drive means is at the selected activated operational state is a selected percentage of the repetition period over a selected first range of the repetition period.

11. An ignition control system as in claim 10 wherein the selected activated operational state is represented by a selected current level for the ignition signal and wherein the first feedback means comprises a current limiting circuit which acts to limit the current of the ignition signal to the selected current level during the time when the output drive means is at the selected activated operational state.

12. An ignition control system as in claim 11 wherein the integrating means further includes circuitry for setting the waveform to zero whe the voltage of the dwell-control reference signal substantially first reaches the voltage of the waveform during the repetition period, thereby to prevent the voltage of the waveform from again exceeding the voltage of the dwell-control reference signal during the repetition period.

* * * * *